US009771761B2

(12) United States Patent
Marchand et al.

(10) Patent No.: US 9,771,761 B2
(45) Date of Patent: Sep. 26, 2017

(54) TORQUE ENHANCED THREADED CONNECTION

(75) Inventors: Nicholas Ryan Marchand, Edmonton (CA); Duane Wang, Edmonton (CA); Ryan Gee, Spring, TX (US)

(73) Assignee: NATIONAL OILWELL VARCO, L.P., Houston, TX (US)

( * ) Notice: Subject to any disclaimer, the term of this patent is extended or adjusted under 35 U.S.C. 154(b) by 972 days.

(21) Appl. No.: 13/808,870

(22) PCT Filed: Jul. 7, 2011

(86) PCT No.: PCT/US2011/043238

§ 371 (c)(1),
(2), (4) Date: Jan. 7, 2013

(87) PCT Pub. No.: WO2012/006455

PCT Pub. Date: Jan. 12, 2012

(65) Prior Publication Data

US 2013/0106102 A1 May 2, 2013

Related U.S. Application Data

(60) Provisional application No. 61/361,988, filed on Jul. 7, 2010.

(51) Int. Cl.

| | |
|---|---|
| ***E21B 7/08*** | (2006.01) |
| ***E21B 17/042*** | (2006.01) |
| ***E21B 19/12*** | (2006.01) |

(52) U.S. Cl.

CPC ..... *E21B 17/042* (2013.01); *E21B 19/12* (2013.01); *Y10T 29/49877* (2015.01)

(58) Field of Classification Search

CPC ... E21B 17/042; E21B 19/12; Y10T 29/49877
USPC ..... 285/81, 89, 92, 355, 390, 382, 400, 385, 285/421

See application file for complete search history.

(56) References Cited

U.S. PATENT DOCUMENTS 1,315,610 A * 9/1919 Schulz ..... 285/81
1,349,518 A 8/1920 Lyle
(Continued)

FOREIGN PATENT DOCUMENTS

CN 1766278 A 5/2006
CN 1639496 A 5/2008
(Continued)

OTHER PUBLICATIONS

Submission of Informal Comments to the Written Opinion of the International Searching Authority Dated Dec. 7, 2009; Serial No. PCT/US2009/041645; Submission Filed Feb. 24, 2010 (4 p.).
(Continued)

*Primary Examiner* — Gregory Binda
(74) *Attorney, Agent, or Firm* — Conley Rose, P.C.

(57) ABSTRACT

Apparatus and method for increasing the torque capacity of threaded connections between tubular members. The apparatus may include a first tubular end coupled with a second tubular end, and a torque member wherein the torque member is torqued against the second tubular member and wherein tapered surfaces are engaged between the torque member and the first tubular member at a tapered surface interface.

18 Claims, 4 Drawing Sheets

(56) References Cited

U.S. PATENT DOCUMENTS

| | | | | | |
|---|---|---|---|---|---|
| 1,393,057 | A | * | 10/1921 | Vollmer | F41A 21/482 285/421 X |
| 1,999,706 | A | | 4/1935 | Spang | |
| 2,102,072 | A | | 12/1937 | Hinderliter | |
| 2,150,221 | A | | 3/1939 | Hinderliter | |
| 2,308,066 | A | | 1/1943 | Evans | |
| 2,644,524 | A | | 11/1946 | Baker | |
| 2,907,589 | A | | 10/1959 | Knox | |
| 3,359,013 | A | | 12/1967 | Knox | |
| 3,427,048 | A | * | 2/1969 | Brown | E21B 33/038 |
| 3,427,050 | A | | 2/1969 | Krieg | |
| 3,608,933 | A | | 9/1971 | Lee | |
| 4,067,404 | A | | 1/1978 | Crase | |
| 4,099,745 | A | | 7/1978 | Cobbs | |
| 4,209,193 | A | | 6/1980 | Ahlstone | |
| 4,220,214 | A | * | 9/1980 | Benoit | 175/61 |
| 4,346,920 | A | | 8/1982 | Dailey | |
| 4,534,585 | A | | 8/1985 | Saliger | |
| 4,613,161 | A | | 9/1986 | Brisco | |
| 4,643,467 | A | | 2/1987 | Wood | |
| 4,658,915 | A | * | 4/1987 | Goris et al. | 175/57 |
| 4,801,160 | A | | 1/1989 | Barrington | |
| 5,050,691 | A | * | 9/1991 | Moses | 175/57 |
| 5,083,821 | A | | 1/1992 | Friend | |
| 5,785,357 | A | | 7/1998 | Foster et al. | |
| 6,755,447 | B2 | | 6/2004 | Galle, Jr. et al. | |
| 6,811,189 | B1 | | 11/2004 | DeLange et al. | |
| 6,840,550 | B2 | | 1/2005 | Sundholm | |
| 6,857,668 | B2 | | 2/2005 | Otten et al. | |
| 2003/0168851 | A1 | | 9/2003 | Winship | |
| 2004/0164548 | A1 | | 8/2004 | Richey et al. | |
| 2004/0211275 | A1 | | 10/2004 | Fich et al. | |
| 2010/0005643 | A1 | | 1/2010 | Evans et al. | |

FOREIGN PATENT DOCUMENTS

| | | | |
|---|---|---|---|
| CN | 201254958 | Y | 6/2009 |
| CN | 101718176 | A | 6/2010 |
| CN | 201377293 | Y | 1/2013 |
| EP | 0268306 | A2 | 5/1988 |
| EP | 1483476 | B1 | 5/2006 |
| FR | 1300262 | | 12/1962 |
| WO | 94/20726 | A1 | 9/1994 |
| WO | 9711303 | | 3/1997 |
| WO | 2008117172 | A2 | 10/2008 |
| WO | 2009/132259 | A2 | 10/2009 |

OTHER PUBLICATIONS

PCT/US2009/041645 International Search Report and Written Opinion Dated Dec. 7, 2009 (12 p.).

Office Action Dated Jun. 15, 2012; U.S. Appl. No. 12/989,388 (16 p.).

Response to Office Action Dated Jun. 15, 2012; U.S. Appl. No. 12/989,388; Response Filed Nov. 15, 2012 (17 p.).

Final Office Action Dated Feb. 28, 2013; U.S. Appl. No. 12/989,388 (9 p.).

Response to Final Office Action Dated Feb. 28, 2013; U.S. Appl. No. 12/989,388; Response Filed May 28, 2013 (8 p.).

Advisory Action Dated Jun. 11, 2013; U.S. Appl. No. 12/989,388 (3 p.).

Request for Continued Examination and Response to Final Office Action Dated Feb. 28, 2013; U.S. Appl. No. 12/989,388; Response Filed Jun. 28, 2013 (15 p.).

Canadian Office Action Dated Jul. 4, 2012; Canadian Application No. 2,721,587 (2 p.).

Canadian Office Action Dated Jul. 22, 2013; Canadian Application No. 2,721,587 (2 p.).

Chinese Office Action dated Dec. 15, 2014; Chinese Application No. 201180033789.5 (3 p.).

English Translation of Chinese Office Action dated Dec. 15, 2014; Chinese Application No. 201180033789.5 (3 p.).

Chinese Office Action dated Apr. 18, 2014; Chinese Application No. 201180033789.5 (11 p.).

Canadian Office Action dated Jul. 2, 2014; Canadian Application No. 2,804,503 (2 p.).

International Application No. PCT/US2011/043238 Search Report and Written Opinion dated Nov. 26, 2012.

European Supplementary Search Report Dated Aug. 27, 2013; European Application No. 09736084 (6 p.).

Canadian Office Action dated Apr. 29, 2015 for Canadian Application No. 2,804,503 (3 p.).

* cited by examiner

TORQUE ENHANCED THREADED CONNECTION

CROSS-REFERENCE TO RELATED APPLICATIONS

This application is the U.S. National Stage under 35 U.S.C. §371 of International Patent Application No. PCT/US2011/043238 filed Jul. 7, 2011, which claims the benefit of U.S. Provisional Application Ser. No. 61/361,988 filed Jul. 7, 2010, entitled "Torque Enhanced Threaded Connection."

STATEMENT REGARDING FEDERALLY SPONSORED RESEARCH OR DEVELOPMENT

Not applicable.

BACKGROUND

The disclosure relates to threaded tubular connections and the like. More particularly, the disclosure relates to an apparatus and method for joining tubular members using threaded sections in a manner that increases the thread torque capacity.

In the oil and gas production industry, pipe or other tubular sections may be connected via threaded connections, such as mating pin and box ends. The threaded connections are often subjected to large torsion forces during downhole operations like drilling. The torque or yield strength of the connection is dictated by the thread profile, the material properties and the dimensions of the mating threaded components. However, due to space or other constraints in a well bore, often times the threaded connection design is limited as to the size and thread type that can be used, thereby limiting the yield strength of the connection. For example, a rotary shouldered connection between two tubular components may include an internal makeup shoulder disposed between the end of the pin and an internal shoulder of the box end. Connections with an internal makeup shoulder may have reduced torque capacity, and may be susceptible to fatigue crack initiation in the pin threads. Thus, it is desirable to increase the yield or torque strength of a threaded connection in other ways.

There remains a need for a threaded connection that advantageously increases the torque strength of a threaded connection, particularly while also staying within current downhole design specifications and the geometric constraints of an earthen borehole.

BRIEF DESCRIPTION OF THE DRAWINGS

For a more detailed description of the preferred embodiments of the present disclosure, reference will now be made to the accompanying drawings, wherein.

DETAILED DESCRIPTION

Figure 1:
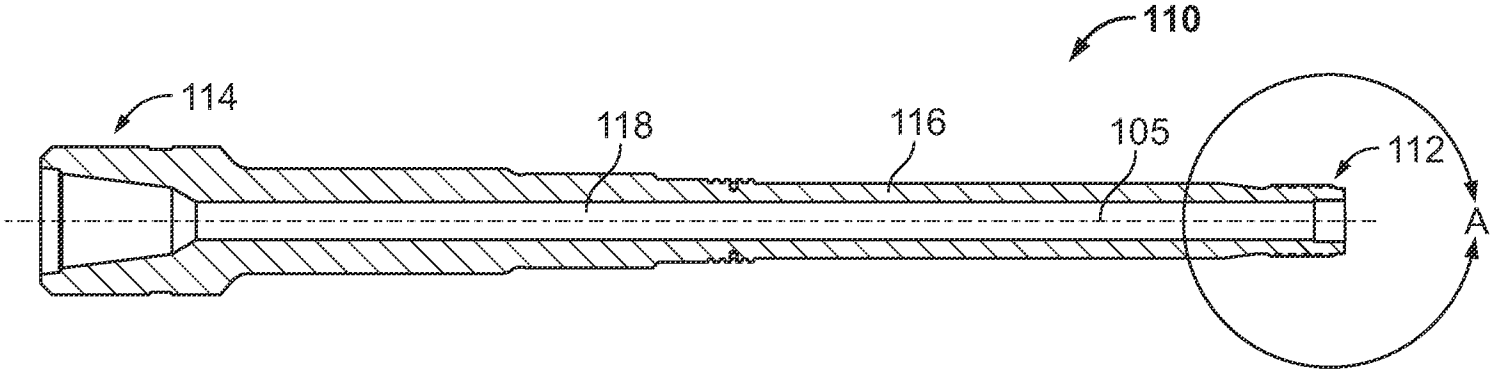
FIG. 1 is a cross-section of a first tubular member, or a tapered pin bearing mandrel, of an embodiment of a torque enhanced threaded connection in accordance with principles disclosed herein.

In the drawings and description that follow, like parts are typically marked throughout the specification and drawings with the same reference numerals. The drawing figures are not necessarily to scale. Certain features of the disclosure may be shown exaggerated in scale or in somewhat schematic form and some details of conventional elements may not be shown in the interest of clarity and conciseness. The present disclosure is susceptible to embodiments of different forms. Specific embodiments are described in detail and are shown in the drawings, with the understanding that the present disclosure is to be considered an exemplification of the principles of the disclosure, and is not intended to limit the disclosure to that illustrated and described herein. It is to be fully recognized that the different teachings of the embodiments discussed below may be employed separately or in any suitable combination to produce desired results.

Unless otherwise specified, any use of any form of the terms "connect", "engage", "couple", "attach", or any other term describing an interaction between elements is not meant to limit the interaction to direct interaction between the elements and may also include indirect interaction between the elements described. In the following discussion and in the claims, the terms "including" and "comprising" are used in an open-ended fashion, and thus should be interpreted to mean "including, but not limited to . . . ". The term "box" refers to an end of a length of pipe having female threads cut into the inner diameter and the term "pin" refers to an end of a length of pipe having male threads cut into the outer diameter. In addition, reference to the terms "left" and "right" are made for purposes of ease of description. The terms "pipe," "tubular member," "casing" and the like as used herein shall include tubing and other generally cylindrical objects. The various characteristics mentioned above, as well as other features and characteristics described in more detail below, will be readily apparent to those skilled in the art upon reading the following detailed description of the embodiments, and by referring to the accompanying drawings.

Use of the concepts of the present disclosure is not limited to pipe thread connections and may find utility in other threaded connection applications, both within oilfield technology and other areas to which the concepts of the current disclosure may be applied.

The torsional capacity of a rotary shouldered connection can be increased by providing a secondary or additional makeup shoulder, or a secondary or additional torque interface, that engages at makeup of the connection. In some embodiments, the secondary makeup shoulder is in addition to the primary makeup shoulder, or primary torque interface, that also engages at makeup of the connection. However, some threaded connections do not have sufficient outer material to provide for an additional, external makeup shoulder. The embodiments described below include a secondary, external makeup shoulder and interface for such a connection.

Figure 2:
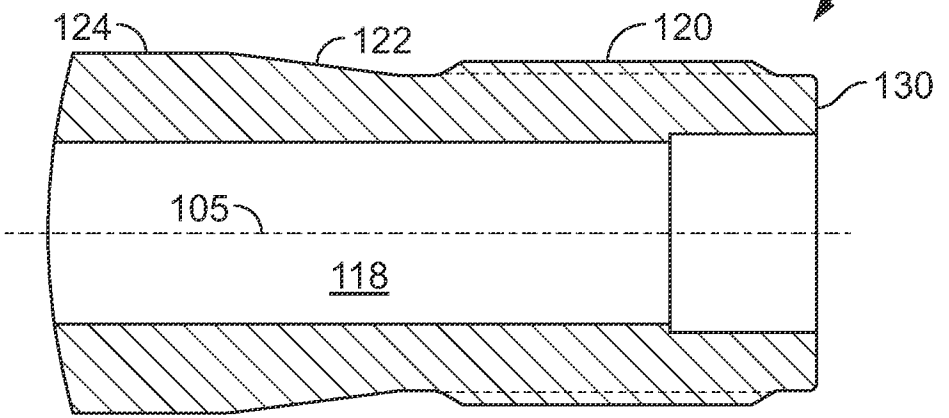
FIG. 2 is an enlarged view of detail A of FIG. 1.

Referring to FIG. 1, a first tubular member 110 includes a threaded or pin end 112, a box end 114, and a tapered intermediate body portion 116. The member 110 may also be referred to as a tapered pin bearing mandrel. The mandrel 110 includes a central flow passage 118. In FIG. 2, the detail A of FIG. 1 shows the pin end 112. The pin end 112 includes a threaded portion 120, an intermediate external tapered surface 122, and a main external surface 124. The terminal end of the pin 112 includes an engagement surface or shoulder 130. In certain exemplary embodiments, the external tapered surface 122 includes a taper, as measured from a longitudinal axis 105 of the first tubular member 110, of seven to eight degrees. In alternative embodiments, the taper is 7.5 degrees. In still further embodiments, the taper is between one and ten degrees, and alternatively can be lower or higher than such a range.

Figure 3:
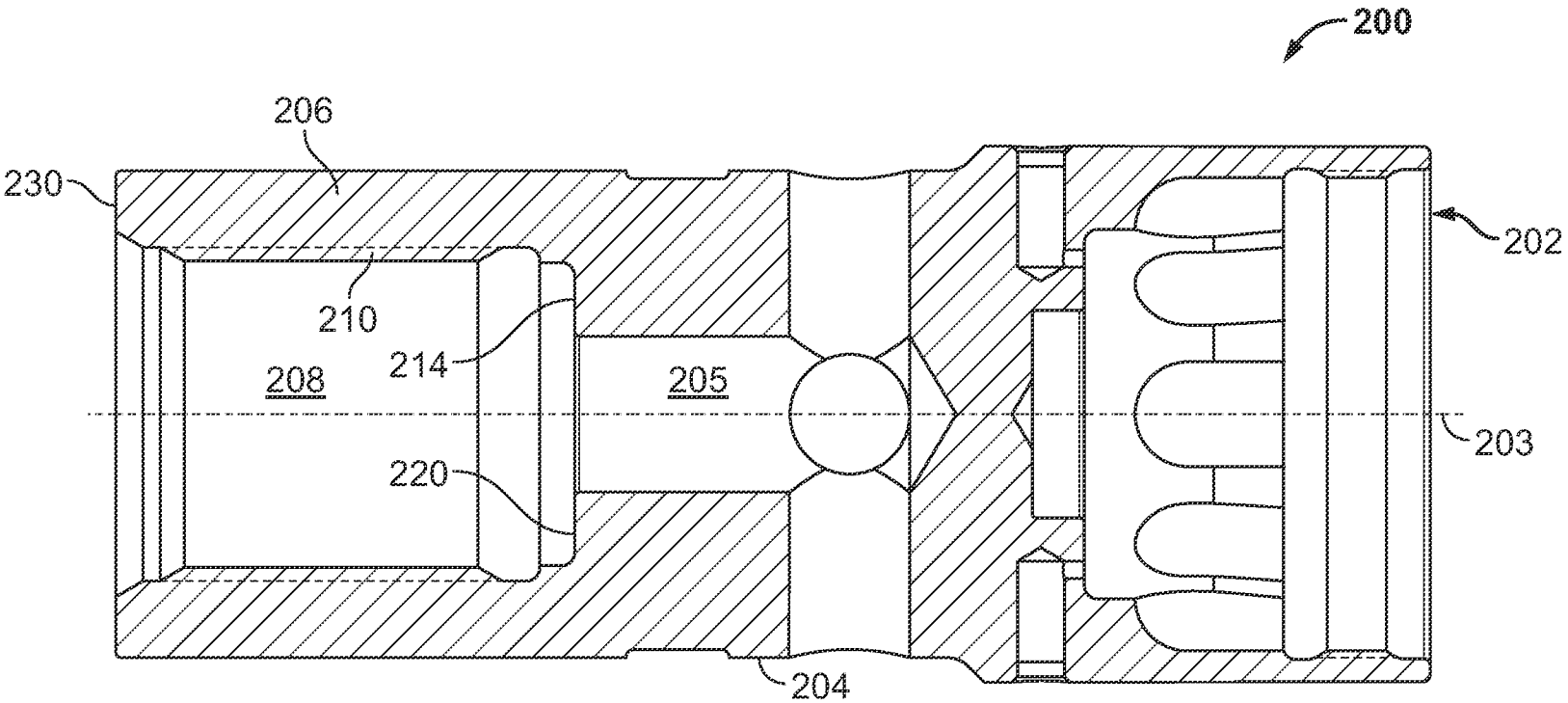
FIG. 3 is a cross-section of a second tubular member, or a bearing adapter and box end, of a torque enhanced threaded connection in accordance with principles disclosed herein.

Referring to FIG. 3, a second tubular member 200, which may also be referred to as a bearing adapter and box end, includes a drive end 202, an intermediate portion 204 with a central bore 205, and a box end 206. In other embodiments, the tubular member 200 includes other kinds of adapters, connectors, subs, or the like. The box end 206 includes a box cavity 208 for receiving a pin end of another tubular member, such as pin member 110, and an engagement surface or shoulder 230. The box cavity 208 includes a shim receptacle 214 with an engagement surface or shoulder 220 and inner surface threads 210. In some embodiments, the box cavity 208 does not include the shim receptacle 214, instead having a uniformly flat end surface.

Figure 4:
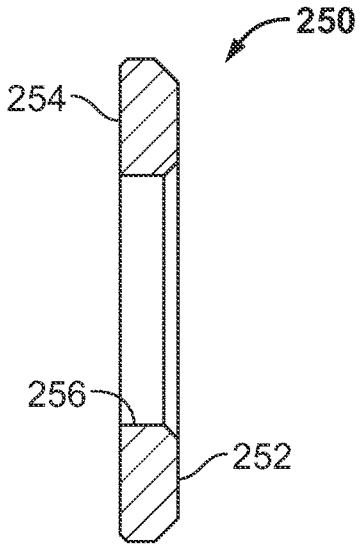
FIG. 4 is a cross-section of a mandrel shim of a torque enhanced threaded connection in accordance with principles disclosed herein.

Referring to FIG. 4, a mandrel shim 250 is shown including a first engagement surface 252, an opposite second engagement surface 254, and a center hole or bore 256. In some embodiments, the mandrel shim 250 is not included.

Figure 5:
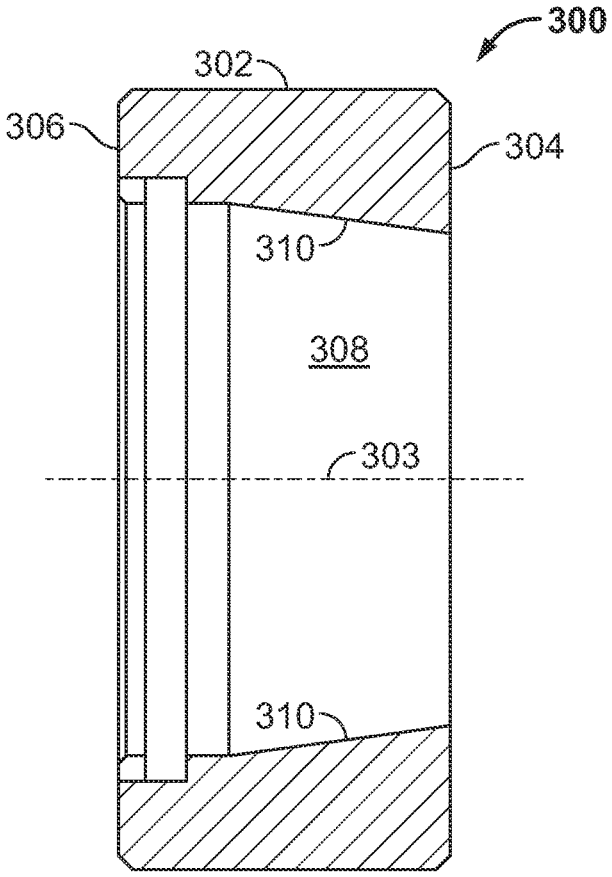
FIG. 5 is a cross-section of a torque member, or a tapered ring member, of a torque enhanced threaded connection in accordance with principles disclosed herein.

Referring to FIG. 5, a torque member 300 is shown. The torque member 300 may also be referred to as a tapered ring member. The tapered ring member 300 includes an outer surface 302, an engagement surface or shoulder 304, an end surface 306, and a central bore or passageway 308. The central bore 308 includes an inner tapered surface 310. In some embodiments, the taper of the tapered surface 310 matches or corresponds to the taper of the tapered surface 122. In certain exemplary embodiments, the inner tapered surface 310 includes a taper, as measured from a longitudinal axis 303 of the torque member 300, of seven to eight degrees. In alternative embodiments, the taper is 7.5 degrees. In still further embodiments, the taper is between one and ten degrees, and alternatively can be lower or higher than such a range.

Figure 6:
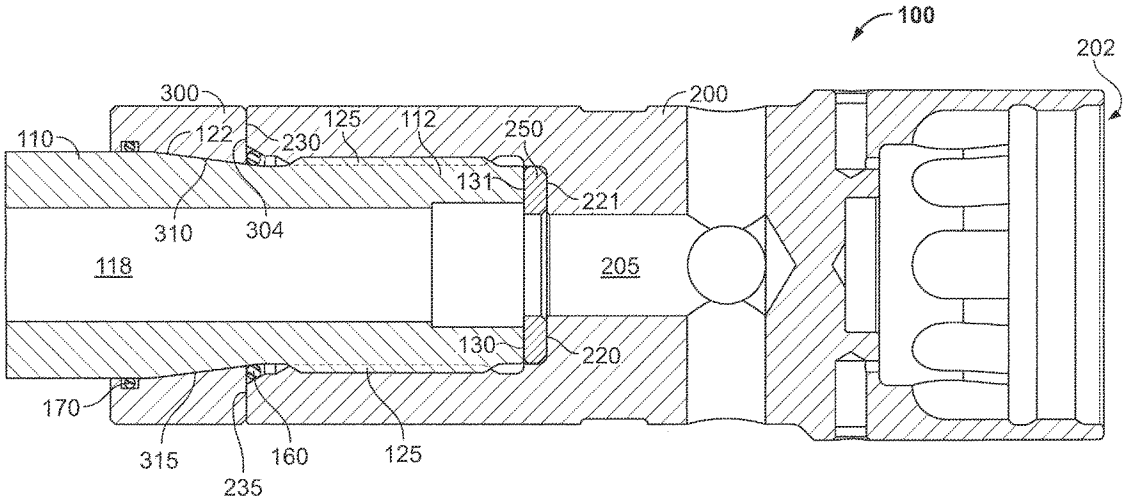
FIG. 6 is a cross-section of an embodiment of an assembled torque enhanced threaded connection including the members of FIGS. 1, 3, 4 and 5.

Referring now to FIG. 6, assembly of the final torque enhanced threaded connection or coupling 100 will be described. The tapered ring member 300 is inserted over the pin end 112 of the tapered pin mandrel 110. In some embodiments, the tapered ring member 300 includes a sufficient inner diameter of the central bore 308 to allow passage over the threads 120 of the pin end 112. In other embodiments, the inner surface of the central bore 308 includes mating threads that engage the threads 120 to allow threaded axial displacement of the ring 300 over the end 112 toward the tapered surface 122. Then, the pin end 112 and the box end 206 are made up by threaded engagement of the threads 120, 210 to form a threaded interface 125. The pin end 112 and box end 206 are engaged at a first, internal makeup shoulder and then at a second, external makeup shoulder including the tapered ring member and the tapered surface interface as will be described more fully below.

In some embodiments, the first, internal makeup shoulder includes the mandrel shim 250. The internal box shoulder 220 engages surface 252 of the shim 250 to form an interface 221 and the pin end face 130 engages the opposing shim surface 254 to form another interface 131. To allow for variance in machining, the shim 250 may be adjusted in axial length to provide finer control of the spacing between the pin and box components and ensure that both shoulder interfaces engage during makeup. Ultimately, the interface 131 provides the internal, torqued makeup shoulder, or internal torquing interface. In alternative embodiments, the mandrel shim 250 is not included, and the first, internal makeup shoulder is a direct interface between the pin end face 130 and the internal box shoulder 220.

In addition to the first, internal makeup shoulder, the assembled connection 100 includes a second, external makeup shoulder. The outer box shoulder 230 engages the tapered ring surface 304 during makeup of the pin end 112 and the box end 206 to provide the second, external makeup shoulder or torquing interface 235. At approximately the same time, the inner tapered surface 310 is backed up against and engages the external tapered surface 122 to form the tapered interface 315. The tapered surface 122 provides an axial backup force to the tapered surface 310 and the torque member 300, which then provides axial force backup for the second torque shoulder or interface 235. Consequently, the two coupled tubular members 110, 200 include a direct, internal torque shoulder or interface 131 and a secondary, external torque shoulder or interface 235 via the axially reinforced torque member 300.

Thus, the torsional capacity of a rotary shouldered connection 100 can be enhanced or maximized by providing a secondary, external makeup shoulder 235 engaged between the coupled tubular members 110, 200 in addition to the primary, internal makeup shoulder 131 also coupled between the two tubular members 110, 200. In the case of a connection with an internal makeup shoulder, there may not be sufficient material to provide for an additional, external makeup shoulder. The ring member 300 provides a secondary, external makeup shoulder 235 for such a connection, while also providing a tapered backup interface 315 with the underlying tubular member 110 that is connected with the second tubular member 200. In some embodiments, the torque interfaces 131, 235 engage substantially simultaneously with one another during makeup of the connection 100. In certain embodiments, the adjustable length shim 250 can be used to ensure simultaneous engagement of both the internal and external torque interfaces 131, 235 during makeup.

Thus, in some embodiments, and still referring to FIG. 6, the torque member 300 is moveable onto and off of the first tubular member 110, and provides an adjustable external shoulder 304 for engagement with the external shoulder 230 or face of the second tubular member 200. The torque member 300 also provides a tapered surface interface 315 between the torque member 300 and the first tubular member 110 for axial force backup to torquing action of the connection. In this manner, the external box end shoulder 230 is torqued against the torque member 300 that includes the additional axial backup force provided by the tapered surface interface 315.

In some embodiments, an apparatus for increasing the torque capacity of a tubular connection includes a first tubular member 110 comprising a first end 112 and an outer tapered surface 122, a torque member 300 having an inner tapered surface 310, the torque member to be moveably coupled on the first end 112, a second tubular member 200 comprising a second end 206 to be coupled to the first end 112, and wherein the torque member 300 includes a first untorqued position, and a second torqued position against the second tubular member 200 end and wherein the tapered surfaces are engaged. In some embodiments, the first tubular member 100 includes an end face 130 to engage an internal shoulder 220 of the second tubular member 200 at a first torquing interface 131, and the torque member 300 engages the second tubular member 200 end at a second torquing interface 235. In some embodiments, the torque member 300 engages at an external shoulder 230 of the second tubular member 200 end in the second torqued position. In some embodiments, the first tubular member 110 includes a pin end having a section of threads 120, wherein the second tubular member 200 includes a box end having a section of threads 210 to receive the pin end threads, and wherein the inner tapered surface 122 of the torque member 300 engages the outer tapered surface 122 of the first tubular member 110 in an axially spaced position from the engaged threads of the first and second tubular members 110, 200.

In some embodiments, the apparatus includes an internal makeup shoulder 131 engaged between the first and second tubular member ends, and an external makeup shoulder 235 engaged between the torque member 300 and the second tubular member end. In some embodiments, the tapered surfaces 122 are engaged between the torque member 300 and the first tubular member 110 to support the engaged external makeup shoulder 235.

In some embodiments, an apparatus for increasing the torque capacity of a tubular connection includes a first tubular member 110 coupled to a second tubular member 200 and having a first torquing interface 131 therebetween, and a moveable torque member 300 coupled to the first tubular member 110 and the second tubular member 200 and providing a second torquing interface 235 between the first tubular member 110 and the second tubular member 200 comprising a tapered interface 315 between the torque member 300 and the first tubular member 110. In some embodiments, the first torquing interface 131 comprises an end face of the first tubular member 110 and an internal shoulder 220 of the second tubular member 200. In some embodiments, the second torquing interface 235 comprises an end face of the torque member 300 and an external shoulder 230 of the second tubular member 200. In some embodiments, the tapered interface axially supports the second torquing interface 235. In some embodiments, the first torquing interface 131 comprises an internal makeup shoulder 131 between the first and second tubular members 110, 200, and the second torquing interface 235 comprises an external makeup shoulder 235 between the torque member 300 and the first tubular member 110. In some embodiments, the torque member 300 is captured between the second tubular member 200 and the tapered interface 315 with the first tubular member 110.

In some embodiments, a method for increasing the torque capacity of a tubular connection includes connecting a torque member 300 to an end of a first tubular member 110, connecting an end of a second tubular member 200 to the end of the first tubular member 110, torquing the first tubular member 110 against the second tubular member 200, and engaging an inner tapered surface 310 of the torque member 300 with an outer tapered surface 122 of the first tubular member 110. The method may include torquing the second tubular member 200 against the torque member 300 to engage the tapered surfaces. The method may include capturing the torque member 300 between the second tubular member 200 and the first tubular member 110 at the engaged tapered surfaces. The method may include providing a first, internal torquing interface 131 between the first and second tubular members 110, 200, and providing a second, external torquing interface 235 between the first and second tubular members 110, 200 via the torque member 300. The method may include axially supporting the second, external torquing interface 235 with the engaged tapered surfaces.

In some embodiments, an apparatus for increasing the torque capacity of a threaded tubular connection includes a first tubular member 110 including a pin end having a section of threads 210, a second tubular member 200 including a box end having a section of threads 210 to receive the pin end threads, and a torque member 300 including an inner tapered 310 surface to engage an external tapered surface 122 of the first tubular member 110 axially spaced from the engaged threads of the first and second tubular members 110, 200.

In other embodiments, the connection between the tubular members includes connection means other than threads.

While the disclosure is susceptible to various modifications and alternative forms, specific embodiments thereof are shown by way of example in the drawings and description. It should be understood, however, that the drawings and detailed description thereto are not intended to limit the disclosure to the particular form disclosed, but on the contrary, the intention is to cover all modifications, equivalents and alternatives falling within the spirit and scope of the present disclosure.

What is claimed is:

1. A tubular connection configured for increased torque capacity, the tubular connection comprising:

a first tubular member comprising a first end and an external surface that is tapered such that the outer diameter of the first tubular member decreases along the external tapered surface;

a torque member having a central bore including an inner surface that is tapered such that the inner diameter of the central bore decreases along the inner tapered surface, the torque member to be moveably coupled on the first end; and a second tubular member comprising a second end to be coupled to the first end;

wherein the torque member is moveable on the first end to a torqued position against the second end and wherein the tapered surfaces are engaged to provide an axial backup force between the torque member and the second tubular member.

2. The tubular connection of claim 1 wherein the first end includes an end face to engage an internal shoulder of the second tubular member at a first torquing interface, and the torque member engages the second end at a second torquing interface.

3. The tubular connection of claim 1 wherein the torque member engages an external shoulder of the second end in the torqued position.

4. The tubular connection of claim 1 wherein the first end includes a pin end having a section of threads, wherein the second end includes a box end having a section of threads to receive the pin end threads, and wherein the inner tapered surface of the torque member engages the outer tapered surface of the first tubular member in a position that is axially spaced from the engaged threads of the first and second tubular members.

5. The tubular connection of claim 1 further comprising an internal makeup shoulder engaged between the first and second ends, and an external makeup shoulder engaged between the torque member and the second end.

6. The tubular connection of claim 5 wherein the tapered surfaces are engaged between the torque member and the first tubular member to support the engaged external makeup shoulder.

7. A tubular connection configured for increased torque capacity, the tubular connection comprising:

a first tubular member coupled to a second tubular member and having a first torquing interface therebetween; and a moveable torque member coupled to the first tubular member and the second tubular member, the torque member providing a second torquing interface disposed between the torque member and the second tubular member and providing a tapered interface between the torque member and the first tubular member;

wherein the first tubular member comprises an external surface that is tapered such that the outer diameter of the first tubular member decreases along the external tapered surface;

wherein the torque member comprises a central bore including an inner surface that is tapered such that the inner diameter of the central bore decreases along the inner tapered surface; and wherein the tapered interface is formed by an engagement of the tapered external surface of the first tubular member and the tapered inner surface of the torque member.

8. The tubular connection of claim 7 wherein the first torquing interface comprises an end face of the first tubular member and an internal shoulder of the second tubular member.

9. The tubular connection of claim 8 wherein the second torquing interface comprises an end face of the torque member and an external shoulder of the second tubular member.

10. The tubular connection of claim 9 wherein the tapered interface axially supports the second torquing interface.

11. The tubular connection of claim 7 wherein the first torquing interface comprises an internal makeup shoulder between the first and second tubular members, and the second torquing interface comprises an external makeup shoulder between the torque member and the second tubular member.

12. The tubular connection of claim 7 wherein the torque member is captured between the second tubular member and the tapered interface with the first tubular member.

13. A method for increasing the torque capacity of a tubular connection comprising:

connecting a torque member, having a first longitudinal axis, to an end of a first tubular member, having a second longitudinal axis;

connecting an end of a second tubular member to the end of the first tubular member;

torquing the first tubular member against the second tubular member; and engaging an inner tapered surface of the torque member with an outer tapered surface of the first tubular member to provide an axial backup force at the inner and outer tapered surfaces and in the direction of the first and second longitudinal axes.

14. The method of claim 13 further comprising torquing the second tubular member against the torque member to engage the tapered surfaces.

15. The method of claim 13 further comprising capturing the torque member between the second tubular member and the first tubular member at the engaged tapered surfaces.

16. The method of claim 13 further comprising providing a first, internal torquing interface between the first and second tubular members, and providing a second, external torquing interface between the first and second tubular members via the torque member.

17. The method of claim 16 further comprising axially supporting the second, external torquing interface with the engaged tapered surfaces.

18. The method of claim 13 further comprising torquing, in response to the axial backup force, the torque member against the second tubular member.

* * * * *